US008745877B2

(12) United States Patent
Szczepanowski et al.

(10) Patent No.: US 8,745,877 B2
(45) Date of Patent: Jun. 10, 2014

(54) MANUALLY ACTUABLE LIQUID DISPENSING RAZOR

(75) Inventors: Andrew Anthony Szczepanowski, North Attleboro, MA (US); James Leo Salemme, Billerica, MA (US); Graham John Simms, Reading (GB); Christopher James Wattam, London (GB); Sean Peter Clarke, Highmoor Cross (GB)

(73) Assignee: The Gillette Company, Boston, MA (US)

( * ) Notice: Subject to any disclaimer, the term of this patent is extended or adjusted under 35 U.S.C. 154(b) by 687 days.

(21) Appl. No.: 12/409,081

(22) Filed: Mar. 23, 2009

(65) Prior Publication Data

US 2010/0236071 A1 Sep. 23, 2010

(51) Int. Cl.
*B26B 21/44* (2006.01)

(52) U.S. Cl.
USPC ..... 30/41; 30/51

(58) Field of Classification Search
USPC ..... 30/41, 41.5, 51
IPC ..... B26B 19/14,21/446
See application file for complete search history.

(56) References Cited

U.S. PATENT DOCUMENTS

| | | | | | |
|---|---|---|---|---|---|
| 1,556,269 | A | * | 10/1925 | Warming | 30/41 |
| 1,836,800 | A | * | 12/1931 | Hope | 30/41 |
| 1,991,405 | A | | 2/1935 | Merriman | |
| 2,292,418 | A | | 8/1942 | Wetherbee | |
| 2,327,192 | A | * | 8/1943 | Keene | 30/41 |
| 2,375,444 | A | | 5/1945 | Schwartz | |
| 2,392,975 | A | | 1/1946 | Cooney | |
| 2,686,361 | A | * | 8/1954 | Resnick et al. | 30/41 |
| 3,015,158 | A | * | 1/1962 | Ayotte | 30/41 |
| 3,080,651 | A | | 3/1963 | La Cas | |
| 3,176,391 | A | * | 4/1965 | Resnick et al. | 30/41 |
| 3,299,506 | A | * | 1/1967 | Gwinn | 30/41 |
| 3,353,264 | A | * | 11/1967 | Waldman | 30/41 |
| 4,077,119 | A | | 3/1978 | Sellera | |
| 4,177,556 | A | | 12/1979 | Galli, Jr. | |
| 4,314,404 | A | | 2/1982 | Ruiz et al. | |
| 4,653,188 | A | | 3/1987 | Kwak | |
| 4,760,642 | A | | 8/1988 | Kwak | |

(Continued)

FOREIGN PATENT DOCUMENTS

| | | |
|---|---|---|
| DE | 480 565 | 7/1929 |
| FR | 2 629 385 A1 | 10/1989 |

(Continued)

*Primary Examiner* — Kenneth E. Peterson
(74) *Attorney, Agent, or Firm* — Jay A. Krebs

(57) ABSTRACT

The invention features a razor for dispensing a fluid during shaving. The razor includes a handle, a razor cartridge, and a fluid dispensing member joined to the cartridge. The handle includes a cavity for housing a fluid and a manually-actuated pump to displace the fluid from the cavity through a supply channel to an opening at the proximal end of the handle. The razor cartridge includes a cartridge connecting structure attached to the housing, at least one blade positioned in the housing, and an aperture that extends from the rear surface to the front surface of the housing. The fluid dispensing member has a dispensing channel with an opening at a supply end and an opening at a dispensing end. The supply end is configured to engage the opening in the supply channel. The dispensing end projects outwardly and extends to or adjacent to the aperture in the housing.

20 Claims, 6 Drawing Sheets

(56) References Cited

U.S. PATENT DOCUMENTS

| | | | | |
|---|---|---|---|---|
| 4,809,432 | A | 3/1989 | Schauble | |
| 4,813,138 | A | 3/1989 | Chen | |
| 4,841,635 | A | 6/1989 | Maurizi et al. | |
| 4,850,107 | A | 7/1989 | Valliades et al. | |
| 4,888,868 | A | 12/1989 | Pritchard | |
| 4,977,669 | A | 12/1990 | Clifford | |
| 5,005,288 | A | 4/1991 | Wilk | |
| 5,014,427 | A | 5/1991 | Byrne | |
| 5,092,041 | A | 3/1992 | Podolsky | |
| 5,103,560 | A | 4/1992 | Podolsky | |
| 5,133,130 | A | 7/1992 | Podolsky | |
| 5,134,775 | A | 8/1992 | Althaus et al. | |
| 5,141,349 | A | 8/1992 | Maguire, Jr. et al. | |
| 5,168,628 | A | 12/1992 | Mock et al. | |
| 5,269,062 | A | 12/1993 | Dallaire et al. | |
| 5,283,952 | A | 2/1994 | Mock et al. | |
| 5,337,478 | A | 8/1994 | Cohen et al. | |
| 5,384,961 | A | 1/1995 | Gregory | |
| 5,402,697 | A | 4/1995 | Brooks | |
| 5,638,601 | A | 6/1997 | Mol et al. | |
| 5,673,485 | A | 10/1997 | Hill | |
| 5,855,066 | A | 1/1999 | Manger | |
| 5,983,500 | A | 11/1999 | da Silva | |
| 5,993,180 | A | 11/1999 | Westerhof et al. | |
| 6,308,413 | B1 | 10/2001 | Westerhof et al. | |
| 6,493,940 | B2 | 12/2002 | Westerhof et al. | |
| 6,655,028 | B2 | 12/2003 | Coffin | |
| 6,665,937 | B2 * | 12/2003 | Furst et al. | 30/41 |
| 6,754,958 | B2 | 6/2004 | Haws et al. | |
| 6,763,590 | B2 | 7/2004 | Guimont et al. | |
| 6,789,321 | B2 * | 9/2004 | Simms | 30/41 |
| RE38,634 | E | 10/2004 | Westerhof et al. | |
| 6,851,190 | B2 | 2/2005 | Guimont et al. | |
| 6,886,254 | B1 | 5/2005 | Pennella | |
| 6,910,274 | B1 | 6/2005 | Pennella et al. | |
| 6,925,716 | B2 | 8/2005 | Bressler et al. | |
| 6,964,097 | B2 | 11/2005 | Franzini et al. | |
| 6,973,730 | B2 | 12/2005 | Tomassetti et al. | |
| 7,043,841 | B2 | 5/2006 | Franzini et al. | |
| 7,103,977 | B2 | 9/2006 | Guimont | |
| 7,111,400 | B2 | 9/2006 | Guimont et al. | |
| 7,137,203 | B2 | 11/2006 | Bressler et al. | |
| 7,178,241 | B1 | 2/2007 | Cummings et al. | |
| 2005/0028370 | A1 | 2/2005 | Pennella | |
| 2005/0123342 | A1 | 6/2005 | Bressler et al. | |
| 2005/0138814 | A1 | 6/2005 | Pennella et al. | |
| 2005/0144785 | A1 | 7/2005 | Bressler et al. | |
| 2005/0144786 | A1 | 7/2005 | Bressler et al. | |
| 2006/0117582 | A1 | 6/2006 | Al Aula | |
| 2008/0289185 | A1 | 11/2008 | Clarke | |
| 2008/0307653 | A1 | 12/2008 | Wattam | |
| 2008/0307660 | A1 | 12/2008 | Clarke | |
| 2010/0115774 | A1 | 5/2010 | De Klerk | |
| 2011/0289776 | A1 * | 12/2011 | Hawes et al. | 30/41 |

FOREIGN PATENT DOCUMENTS

| | | | |
|---|---|---|---|
| FR | 2 634 154 | A1 | 1/1990 |
| FR | 2 752 186 | A1 | 2/1998 |
| GB | 2 141 656 | A | 1/1985 |
| GB | 2 246 314 | A | 1/1992 |
| GB | 2 417 007 | A | 2/2006 |
| WO | WO 96/05028 | | 2/1996 |
| WO | WO 2005/087040 | A1 | 9/2005 |
| WO | WO 2006/016159 | A1 | 2/2006 |
| WO | WO 2008/134776 | A1 | 11/2008 |
| WO | WO 2008/152594 | A1 | 12/2008 |
| WO | WO 2008/152601 | A1 | 12/2008 |

* cited by examiner

MANUALLY ACTUABLE LIQUID DISPENSING RAZOR

FIELD OF THE INVENTION

This invention relates to a manually actuable liquid dispensing razor.

BACKGROUND OF THE INVENTION

This invention relates to the field of wet shaving which is the process where a razor with one or more sharpened blades is moved along skin to cut hair. When a consumer engages in the wet shaving experience, it is typical to apply a skin preparation, e.g., shaving soap, shaving cream, shaving gel, skin conditioning foam, etc., via a brush or manual application prior to movement of the razor along the skin's surface. Most consumers find this type of preparation to be rather inconvenient because of the need for multiple shaving products, e.g., a wet razor and a skin preparation product, as well as the undesirable necessity for multiple application steps during the wet shaving process. This multi-step process also results in an overall extended shaving experience which most consumers do not prefer given typical morning hygiene routines. It may, however, be desirable sometimes to apply fluids of other kinds to the skin before, during, or after shaving. It has been found that especially in the case of males who shave facial hair, it is important to provide a shave preparation of some sort prior to shaving in order to adequately hydrate the coarser facial hairs to allow for an easier and closer shave.

In the past, there have been a number of wet shaving product configurations that include a system for conveying a shaving preparation during shaving, e.g., a lubricating fluid, from a reservoir incorporated in the razor structure in the form of a hollowed out razor handle or even an aerosol can that acts as a razor handle, to a dispensing location near the head of the razor. A number of more recent wet razors have cartridges that are movably mounted, in particular pivotable, relative to the handle structures on which they are mounted either permanently, in the case of disposable safety razors intended to be discarded when the blade or blades have become dulled, or detachably to allow replacement of the blade unit on a reusable handle structure. An exemplary razor of this sort is disclosed in U.S. Pat. No. 6,789,321 or U.S. Pat. No. 7,127,817. Many of these types of razors that are capable of conveying a liquid to the skin surface are unfortunately plagued by a number of problems. For instance, the inner workings of the razors tend to be cost prohibitive from a large scale manufacturing standpoint. Additionally, there are safety and performance issues that are constantly experienced due to microbial growth with the reservoir due to the continued exposure of a portion of the remaining liquid to air. This exposure of the liquid to air may oftentimes result in clogging of the razor's inner workings by the liquid resulting in a nonperforming shaving product.

However, a need therefore exists to provide a razor that overcomes the aforementioned problems.

SUMMARY OF THE INVENTION

In an aspect, the invention features a wet shaving razor for dispensing a fluid during shaving. The razor comprises a handle, a razor cartridge, and a fluid dispensing member. The handle has a length that extends from a proximal end to a distal end. The handle also includes a cavity for housing a fluid disposed within the handle and a manually-actuated pump located along the length of the handle. The pump is adapted to displace the fluid from the cavity through a supply channel to an opening at the proximal end of the handle. The razor cartridge includes: a housing having a top portion, bottom portion, front surface, and rear surface; a cartridge connecting structure attached to the rear surface of the housing; at least one blade positioned between the top portion and the bottom portion; and an aperture located between the top portion and the bottom portion such that the aperture extends from the rear surface to the front surface.

The fluid dispensing member is joined to the cartridge connecting structure and has a dispensing channel with an opening at a supply end and an opening at a dispensing end. The supply end is configured to engage the opening in the supply channel whereas the dispensing end projects outwardly and extends to or adjacent to the aperture in the housing. Upon engaging the supply end with the supply channel, the fluid dispensing member is in fluid communication with the pump and actuation of the pump displaces the fluid from the cavity through the aperture to or adjacent to the front surface of the housing.

In another aspect, the fluid dispensing member may have a plurality of openings at the dispensing end and the razor cartridge has a plurality of apertures. In this embodiment, the dispensing end projects outwardly and extends into the plurality of apertures to or adjacent to the front surface. Upon engaging the supply end with the supply channel, the fluid dispensing member is in fluid communication with the pump and actuation of the pump displaces the fluid from the cavity through the plurality of apertures to or adjacent to the front surface of the housing.

In yet another embodiment, the invention features a method of dispensing fluid from a wet shaving razor during shaving. The method includes providing a wet shaving razor, as described above, and actuating the pump thereby displacing the fluid from the cavity through the aperture to or adjacent to the front surface of the housing.

Certain implementations of the invention may include one or more of the following features. Typically, the fluid is stored in the cavity in a sachet, which can be replaceable or refillable. The fluid dispensing member may be integrally formed with the cartridge connecting structure. The fluid dispensing member may extend to or adjacent to the front surface of the housing allowing for direct contact to a user during shaving. The dispensing end of the fluid dispensing member may engagably mate with the housing. In an embodiment, the dispensing channel includes at least two openings at the dispensing end to provide for multiple dispensing points. To prevent the fluid from leaking, any or all of the openings may comprise a check valve.

The razor cartridge may be replaceable or pivotally connected to the cartridge connecting structure. In an aspect, the cartridge connecting structure includes at least one arm to releasably engage the housing. Additionally, the razor cartridge may include a guard as well as an elastomeric member disposed on the guard.

The pump includes a wall, either movable or rigid, upon which force is acted upon to move the fluid through. In the case of a movable wall, the movable wall may be located on one or more of an upper or lower surface of the handle. For a rigid wall, the force causes the movement of non-rigid sidewalls of the pump to move a fluid through to the channel.

Other features and advantages of the invention will be apparent from the description and drawings, and from the claims.

DETAILED DESCRIPTION OF THE INVENTION

Figure 1:
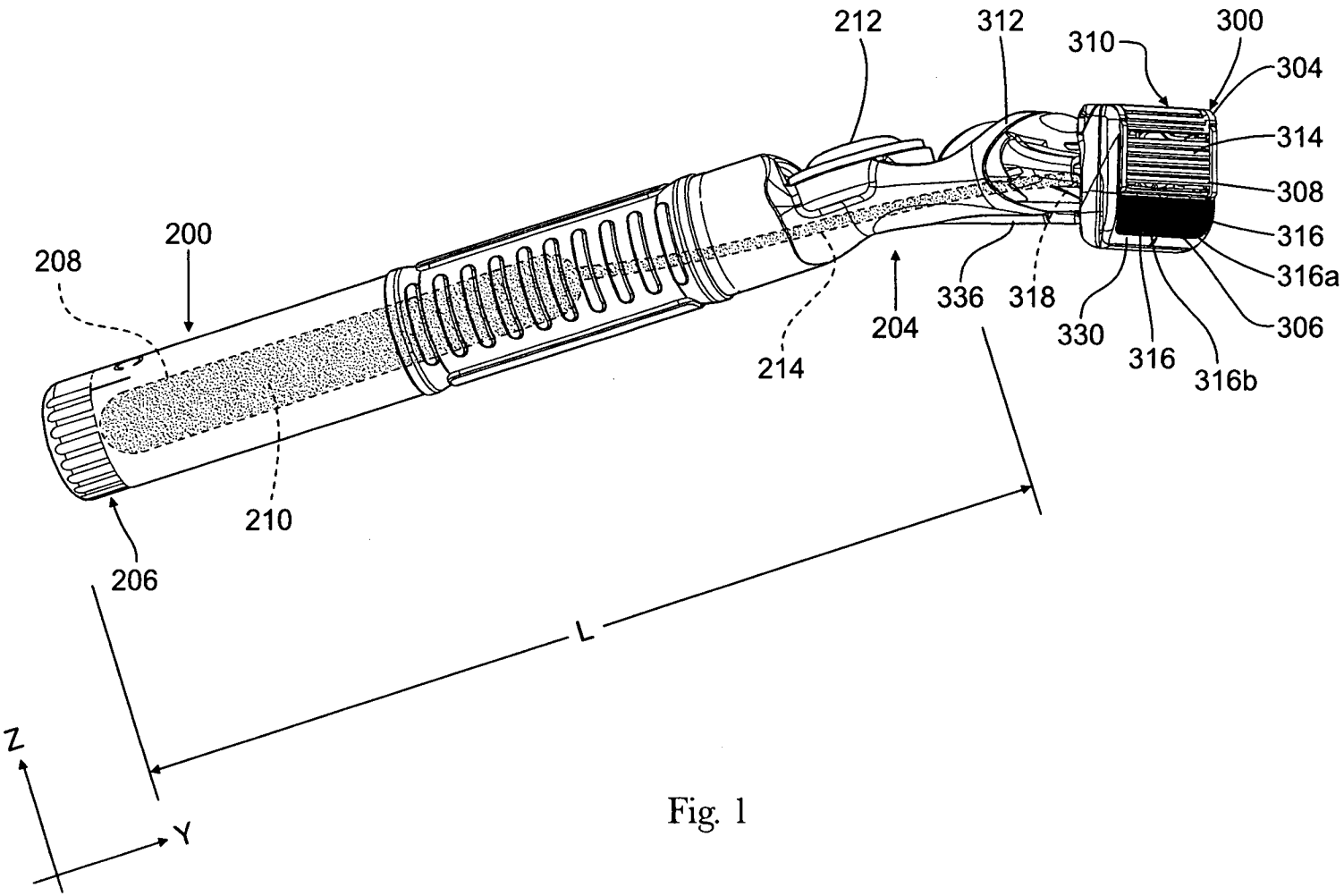
FIG. 1 is a perspective view of a wet shaving razor of the present invention.
Figure 2:
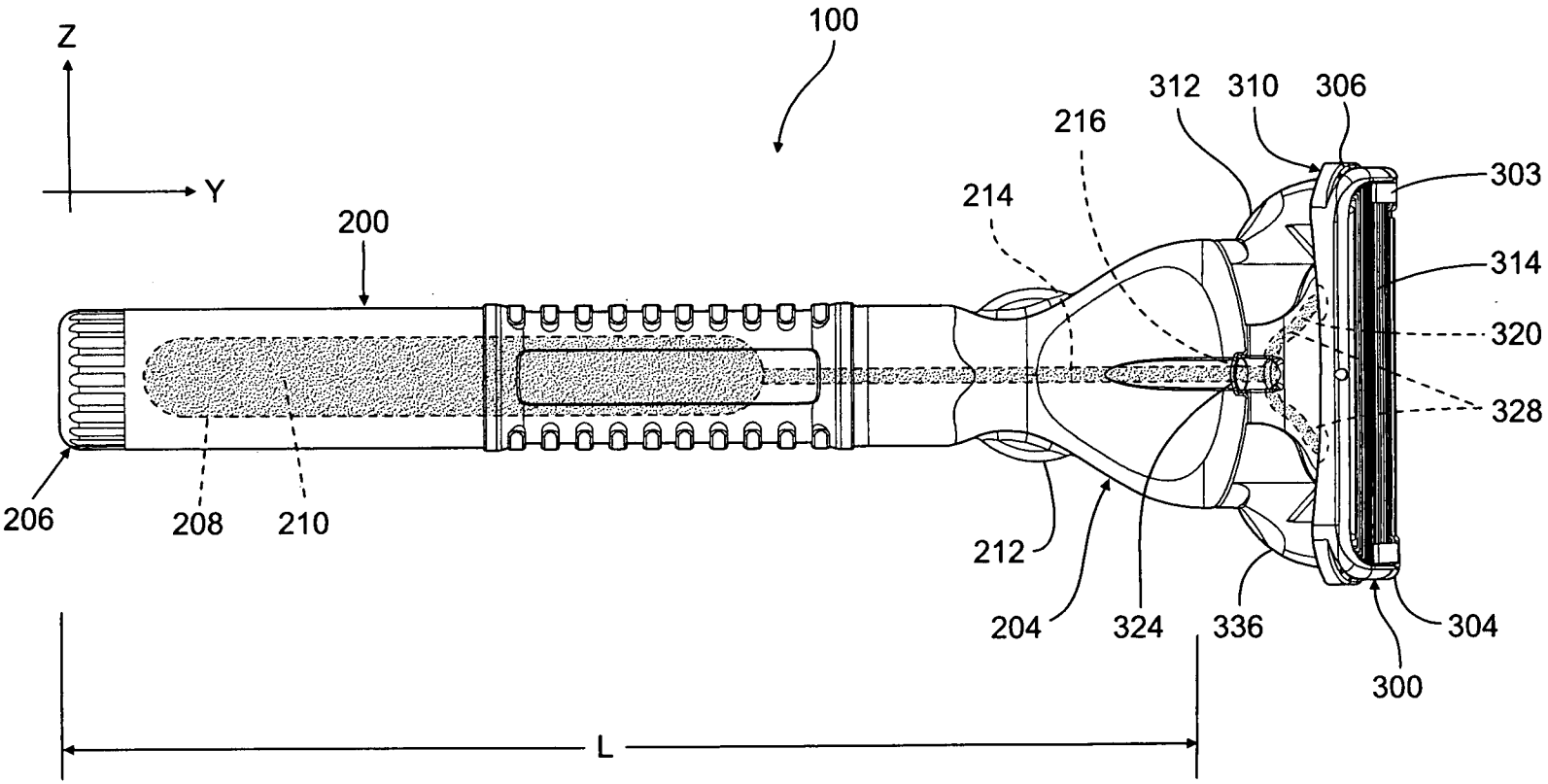
FIG. 2 is a bottom elevational view of the razor.
Figure 3:
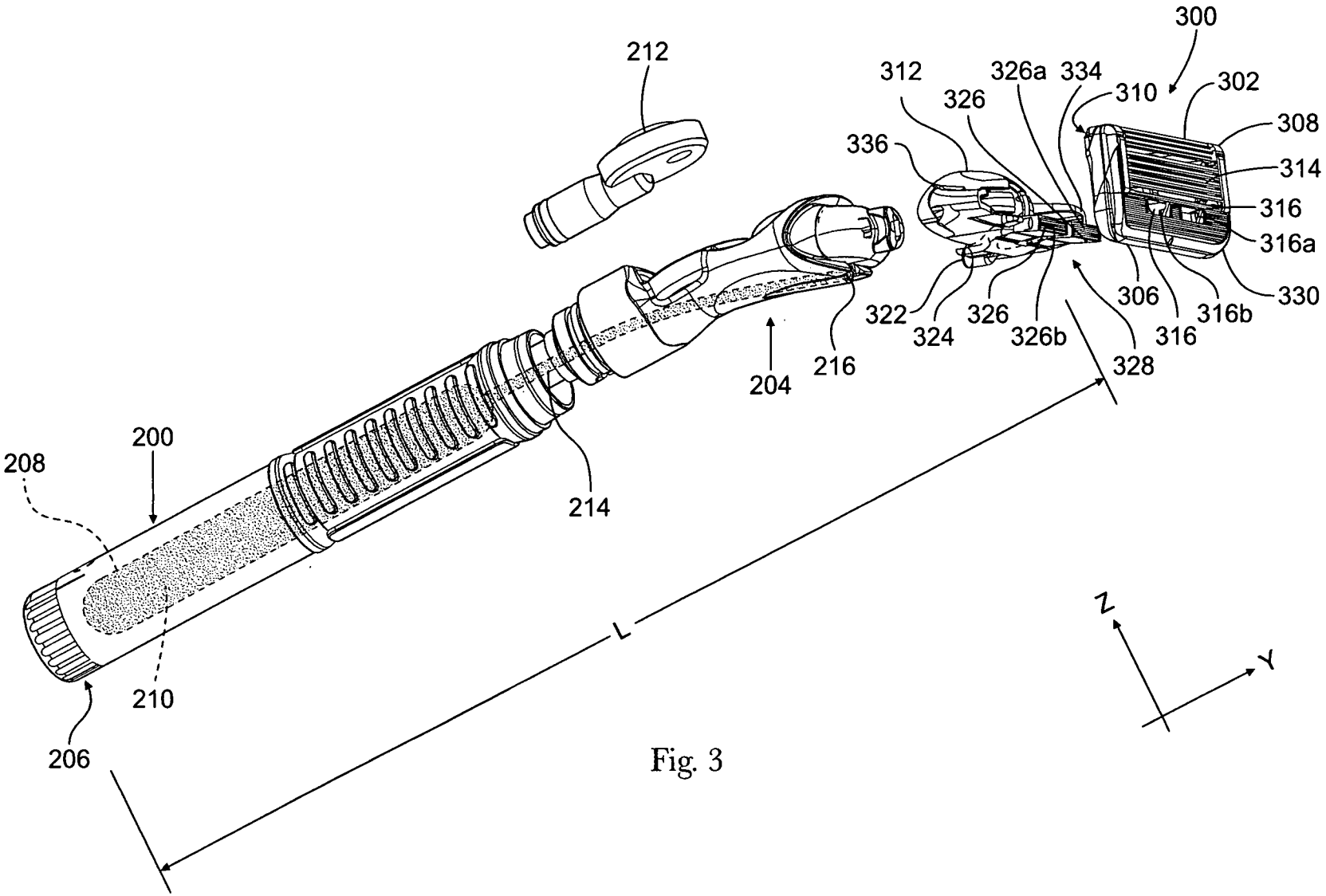
FIG. 3 is an exploded perspective view of FIG. 1.
Figure 4:
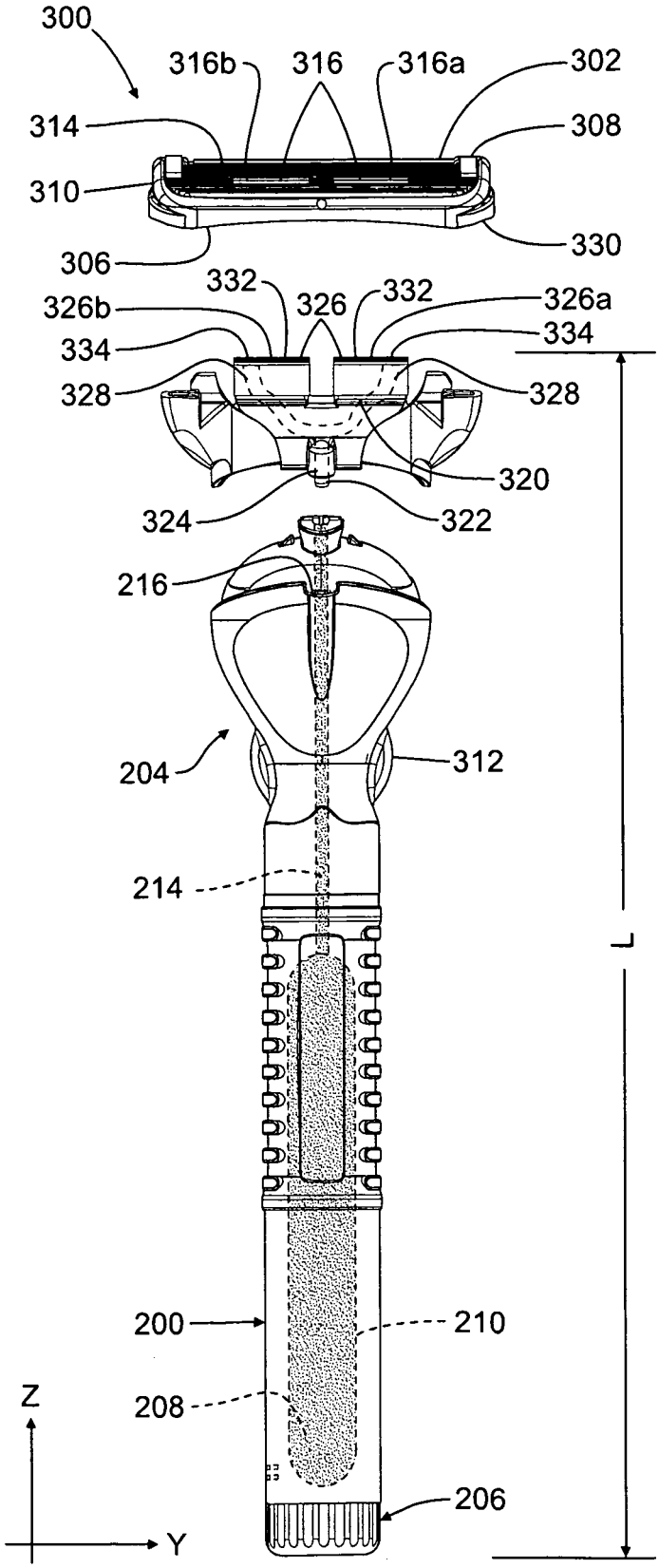
FIG. 4 is an exploded bottom view of FIG. 1.
Figure 5:
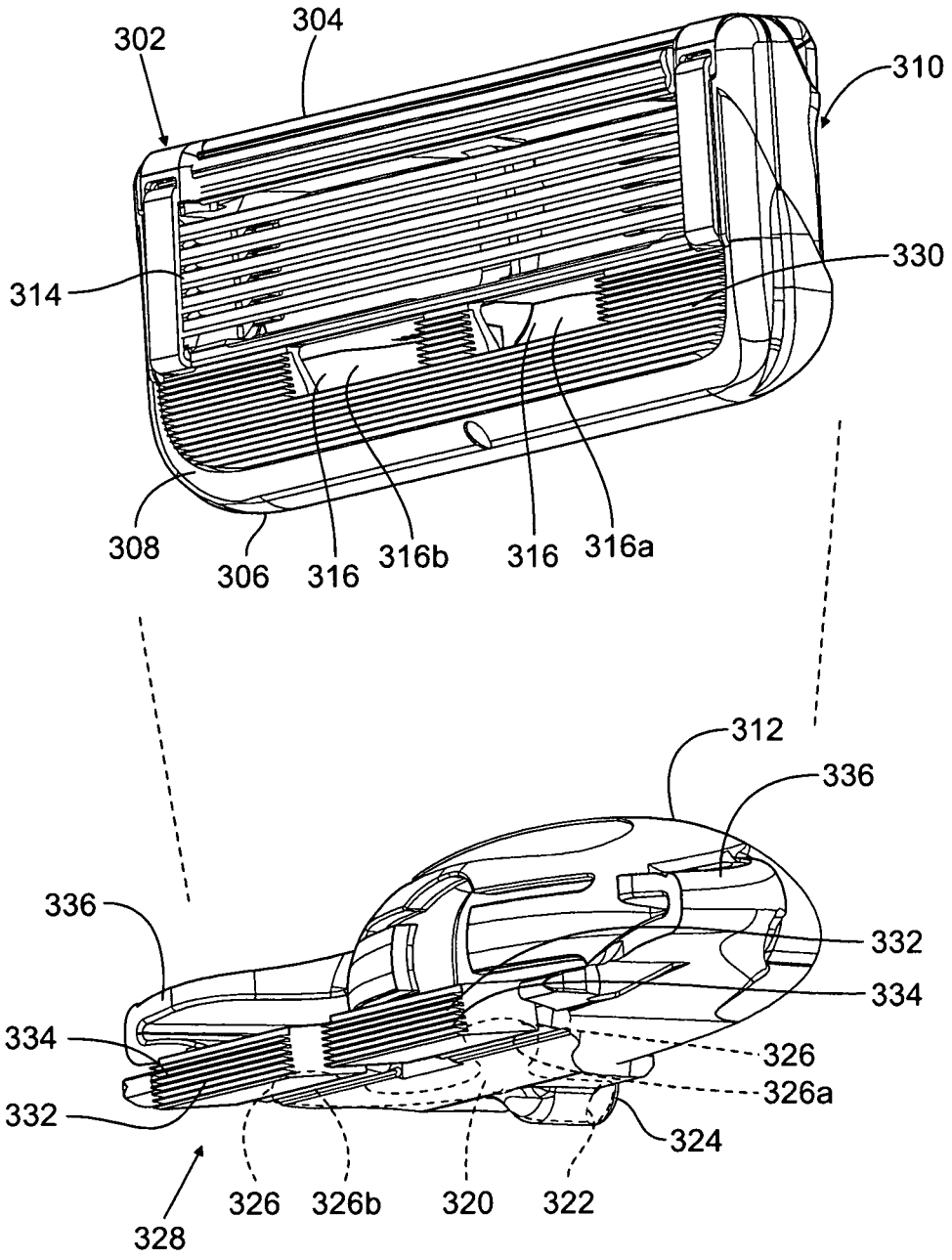
FIG. 5 is an exploded perspective view of the razor cartridge of FIG. 1.

FIGS. 1-5 show a wet shaving razor (100) for dispensing a fluid during shaving that includes a handle (200) and a razor cartridge (300). The handle (200) has a length (L) that extends from a proximal end (204) to a distal end (206). The handle also includes a cavity (208) for housing a fluid (210) disposed within the handle (200) and a manually-actuated pump (212) located along the length (L) of the handle (200). The pump (212) is adapted to displace the fluid (210) from the cavity (208) through a supply channel (214) to an opening (216) at the proximal end (204) of the handle (200).

The manually-actuated pump (212) may include stacked (and substantially flat) components and particularly a movable wall that acts to activate the flow of fluid from the cavity through channel and to the opening. A pump suitable for use in the present invention is disclosed in U.S. Pat. No. 5,993,180. In particular, this well-suited pump includes a pump chamber bounded by the movable wall, an inlet channel and an outlet channel, both of which are connected to the pump chamber, an inlet valve for closing the inlet channel, and an outlet valve for closing the outlet channel. The movable wall of the pump may take a number of forms. For instance, one movable wall embodiment may comprise a rigid topside that moves in the z-direction in response to a force acted upon the rigid topside that in turn causes non-rigid side walls of the pump to compress to move a fluid through the razor. In another instance of the present invention, the movable wall may comprise a rigid central region surrounded by a flexible periphery such that the movable wall's tactile characteristics vary within the single plane of the topside. In this instance the side walls may be either rigid or flexible. In another embodiment, the topside surface of the wall may be flexible such that the mere application of force to the flexible topside results in a "movable" wall that gives in response to such force. In most instances, the pump may be actuated by the pressure exerted by a user's finger such that the user may easily determine the requisite amount of fluid for one or more shaving strokes. Because the valves of the pump are automatically opened when pressure is applied by the user's finger pressure, the fluid can be dispensed in controlled and metered quantities without relying on judgment or dexterity of the user. It is also possible to place one or more movable walls of the pump on an upper surface or lower surface of the razor depending on a user's preference.

The cavity (208), or at least a container/sachet within the cavity (208), contains the fluid (210) to be dispensed during shaving. In an embodiment, the fluid (210) in the cavity or container is refillable or replaceable. The container may have multiple chambers that allow fluids to mix upon being dispensed. The fluid may include shaving gels, shaving foams, shaving lotions, skin treatment compositions, conditioning aids, etc., all which may be used to prepare the skin's surface prior to the engagement of the blade with the skin. Additionally, such materials may comprise benefit agents suitable for skin and/or hair that may be useful for a number of different desirable effects including exfoliation, cooling effects, cleansing, moisturizing, warming or thermogenic effects, conditioning, and the like. Suitable benefit agents for skin and/or hair for inclusion into the fluid of the razor are disclosed in U.S. Pat. No. 6,789,321. For instance, suitable agents include but are not limited to shaving soaps, lubricants, skin conditioners, skin moisturizers, hair softeners, hair conditioners, fragrances, skin cleansers, bacterial or medical lotions, blood coagulants, anti-inflammatories, astringents, and combinations thereof. In certain embodiments, the fluid may be contained in a sachet, either disposable or reusable, that is further contained within the cavity of the handle.

Referring to FIGS. 1-5, the razor cartridge (300) includes a housing (302) having a top portion (304), bottom portion (306), front surface (308), and rear surface (310). At least one blade (314) is positioned between the top portion (304) and the bottom portion (306). The razor cartridge (300) may also include multiple blades. For example, U.S. Pat. No. 7,168,173 generally describes a Fusion® razor that is commercially available from The Gillette Company which includes a razor cartridge with multiple blades. Additionally, an aperture (316) is located between the top portion (304) and the bottom portion (306) such that the aperture (316) extends from the rear surface (310) to the front surface (308). In an embodiment, the housing (302) may also contain clips that are useful for retaining and maintaining the stability of the blades before, during, and after use of the razor.

The cartridge (300) attaches to the rear surface (310) of the housing (302) by a cartridge connecting structure (312). The cartridge connecting structure (312) may include one or more arms (336) that extend to provide pivotal support of the housing (302). Alternatively, the cartridge connecting structure (312) may include an ejection mechanism (e.g., a button) to disengage the housing (302) from the cartridge connecting structure (312).

The razor cartridge (300) may also include a guard (330) or lubricating strip located between the top portion (204) and bottom portion (206). The guard (330) is useful for stretching the skin's surface immediately prior to engagement with the blade or a first blade (when more than one blade is present). This guard (330) may typically comprise an elastomeric member to allow for an engagement that is comfortable to a user. U.S. Pat. No. 7,168,173 discloses a suitable razor cartridge and elastomeric material without the apertures. The elastomeric material can be selected as desired. Typically, the elastomeric material used is a block copolymer (or other suitable materials), e.g., having a durometer between 28 and 60 Shore A.

The lubricating strip, on the other hand, provides an additional treatment to the skin after contact between the fluid and the skin has occurred. The lubricating strip may contain the same or additional skin ingredients to those that are present in the fluid. Suitable lubricating strips are disclosed in U.S. Pat. Nos. 7,069,658, 6,944,952, 6,594,904, 6,182,365, D424,745, 6,185,822, 6,298,558 and 5,113,585.

The cartridge connecting structure (312) may be releasably engaged from the handle (300), as disclosed in U.S. Pat. Nos. D533,684, 5,918,369, and 7,168,173. This disengagement of these two components allows for replacement of razor cartridges as the continued use of such cartridges causes blade dulling. Thus, such cartridges are replaceable and disposable at will by the user.

As shown in FIGS. 1-5, the razor cartridge also comprises a fluid dispensing member (318) joined to the cartridge connecting structure (312). The fluid dispensing member (318) has a dispensing channel (320) with an opening (322) at a supply end (324) and an opening (326) at a dispensing end (328). The supply end (324) is configured to engage the opening (216) in the supply channel (214). The dispensing end (328) projects outwardly and extends to or adjacent to the aperture (216) in the housing (L). Upon engaging the supply end (324) with the supply channel (214), the fluid dispensing member (318) is in fluid communication with the pump (312) and actuation of the pump (312) displaces the fluid (312) from the cavity (208) through the aperture (216) to or adjacent to the front surface (208) of the housing (L).

If a clog or problem occurs in the dispensing channel (320) and/or the razor cartridge (200), e.g., blades become dull, a user can simply replace the cartridge (300) and accompanying fluid dispensing member (318). The fluid dispensing member (318) may be integrally formed with the cartridge connecting structure (312). For example, the fluid dispensing member (318) may be molded and/or formed as a single assembly with the cartridge connecting structure (312).

The dispensing end (328) may extend to or adjacent to the front surface (308) of the housing (302) and may even contact a user during shaving. In another embodiment, the dispensing end (328) engagably mates with the housing (302). To provide additional comfort to the user, the opening (326) may have an elastomer tip (332) with at least one opening (334) formed over it thereby allowing fluid (210) to be dispensed through. To insure the shaving experience feels consistently throughout, the same or similar elastomeric material as in the guard (330) may be used. To prevent the fluid from leaking while the razor (100) is not in use, any or all of the openings (e.g., 216, 322, 326, 334) may be a check valve, e.g., a slit valve, a duck valve, or other suitable valves.

As shown in FIGS. 1-5, the fluid dispensing member (318) may have a plurality of openings (326*a*, 326*b*) at the dispensing end (328) and the razor cartridge (200) includes a plurality of apertures (316*a*, 316*b*). In this embodiment, the dispensing end (328) projects outwardly and extends into the plurality of apertures (316*a*, 316*b*) to or adjacent to the front surface (208). Upon engaging the supply end (324) with the supply channel (214), the fluid dispensing member (318) is in fluid communication with the pump (212). Actuation of the pump (212) displaces the fluid (210) from the cavity (208) through the plurality of apertures (316*a*, 316*b*) to or adjacent to the front surface (308) of the housing (302).

Figure 6:
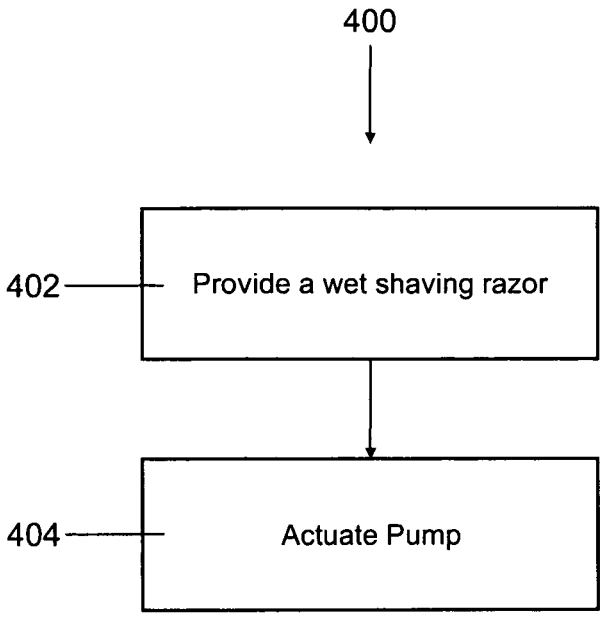
FIG. 6 is a flowchart of a method of using the razor of FIG. 1.

Referring to FIG. 6, the invention features a method of dispensing fluid from a wet shaving razor during shaving (400). The method includes providing a wet shaving razor (402), as described above, and actuating the pump (404) thereby displacing the fluid from the cavity through the aperture to or adjacent to the front surface of the housing.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet shaving razor for dispensing a fluid during shaving, the razor comprising:

(a) a handle having a length that extends from a proximal end to a distal end, the handle comprising 1) a cavity for housing a fluid disposed within the handle, and 2) a manually-actuated pump located along the length of the handle, the pump adapted to displace the fluid from the cavity through a supply channel to an opening at the proximal end of the handle; and (b) a razor cartridge comprising 1) a housing comprising a top portion, bottom portion, front surface, and rear surface, and at least one blade positioned between the top portion and bottom portion, an aperture located between the top portion and bottom portion that extends from the rear surface to the front surface, and;

2) a cartridge connecting structure attached to the rear surface of the housing, wherein the cartridge connecting structure engages the proximal end of the handle, (c) a fluid dispensing member joined to the cartridge connecting structure, the fluid dispensing member having a dispensing channel with an opening at a supply end and an opening at a dispensing end, the opening at the supply end being configured to removably engage the opening in the supply channel, the dispensing end having an elastomeric tip and projecting outwardly and extending to or adjacent to the aperture in the housing such that when the housing is removed from the cartridge connecting structure, the elastomeric tip and the fluid dispensing member stay with the cartridge connecting structure, wherein removing said cartridge connecting structure from said handle also detaches said opening at the supply end of the dispensing channel of the dispensing member which is joined to the cartridge connecting structure from the opening in the supply channel at the proximal end of the handle, and wherein the fluid dispensing member is in fluid communication with the pump upon engaging the supply end with the supply channel, and wherein actuation of the pump displaces the fluid from the cavity through the aperture to or adjacent to the front surface of the housing.

2. The razor of claim 1, wherein the dispensing end engagably mates with the housing.

3. The razor of claim 1, wherein the dispensing channel further comprises at least two openings at the dispensing end such that the dispensing channel provides fluid to the at least two openings.

4. The razor of claim 1, wherein the fluid dispensing member is integrally formed with the cartridge connecting structure.

5. The razor of claim 1, wherein the cavity comprises a sachet of fluid.

6. The razor of claim 1, wherein the razor cartridge further comprises a guard.

7. The razor of claim 6, wherein the dispensing end is positioned at or adjacent to the guard.

8. The razor of claim 1, wherein any or all of the openings comprises a check valve at the respective opening.

9. The razor of claim 1, wherein the razor cartridge further comprises a guard and wherein the elastomeric tip is disposed on said guard.

10. The razor of claim 1, wherein the pump comprises a movable wall upon which force is acted upon to move the fluid through to the channel.

11. The razor of claim 1 wherein the pump comprises a rigid wall upon which force is acted upon to cause the movement of non-rigid sidewalls of the pump to move a fluid through to the channel.

12. The razor of claim 1, wherein the razor cartridge is replaceable.

13. The razor of claim 1, wherein the razor cartridge is pivotally connected to the cartridge connecting structure.

14. The razor of claim 1, wherein said housing forming a guard located between the at least one blade and the bottom portion, said guard forming said aperture.

15. The razor of claim 1, wherein the elastomeric tip extends to or adjacent to the front surface of the housing.

16. The razor of claim 15, wherein said elastomeric tip of said dispensing member forms a portion of said guard fitting into said aperture.

17. The razor of claim 1, wherein removing said cartridge connecting structure from the rear surface of the housing removes said fluid dispensing member from said aperture in said housing.

18. A method of dispensing fluid from a wet shaving razor during shaving, the method comprising:

(a) providing a wet shaving razor, the wet shaving razor comprising a handle having a length that extends from a proximal end to a distal end, the handle comprising a cavity for housing a fluid disposed within the handle, and a manually-actuated pump located along the length of the handle, the pump adapted to displace the fluid from the cavity through a supply channel to an opening at the proximal end of the handle; and a razor cartridge comprising:

a housing comprising a top portion, bottom portion, front surface, and rear surface, and at least one blade positioned between the top portion and bottom portion, an aperture located between the top portion and bottom portion that extends from the rear surface to the front surface, and a cartridge connecting structure attached to the rear surface of the housing, wherein the cartridge connecting structure engages the proximal end of the handle, a fluid dispensing member joined to the cartridge connecting structure, the fluid dispensing member having a dispensing channel with an opening at a supply end and an opening at a dispensing end, the opening at the supply end being configured to removably engage the opening in the supply channel, the dispensing end having an elastomeric tip and projecting outwardly and extending to or adjacent to the aperture in the housing such that when the housing is removed from the cartridge connecting structure, the elastomeric tip and the fluid dispensing member stay with the cartridge connecting structure, wherein removing said cartridge connecting structure from said handle also detaches said opening at the supply end of the dispensing channel of the dispensing member which is joined to the cartridge connecting structure from the opening in the supply channel at the proximal end of the handle, and wherein the fluid dispensing member is in fluid communication with the pump upon engaging the supply end with the supply channel; and (b) actuating the pump thereby displacing fluid from the cavity through the aperture to or adjacent to the front surface of the housing.

19. The method of claim 18, wherein removing said cartridge connecting structure from the rear surface of the housing removes said fluid dispensing member from said aperture in said housing.

20. The razor of claim 18, wherein the fluid dispensing member is integrally formed with the cartridge connecting structure.

* * * * *